United States Patent [19]

Kelch

[11] Patent Number: 4,501,251

[45] Date of Patent: Feb. 26, 1985

[54] BOOSTER PUMP ARRANGEMENT FOR FEEDING A SECONDARY CIRCULATION SYSTEM IN THE OPERATIVE SYSTEM OF A DIESEL ENGINE

[75] Inventor: Heinz Kelch, Königsfeld, Fed. Rep. of Germany

[73] Assignee: Kienzle Apparate GmbH, Villingen, Fed. Rep. of Germany

[21] Appl. No.: 578,279

[22] Filed: Feb. 8, 1984

[30] Foreign Application Priority Data

Feb. 11, 1983 [DE] Fed. Rep. of Germany ..... 3304723

[51] Int. Cl.[3] ..... F02M 41/00

[52] U.S. Cl. ..... 123/495; 123/509; 123/198 C; 417/229

[58] Field of Search ..... 123/495, 509, 198 C, 123/445; 417/199 R, 229, 313, 572

[56] References Cited

U.S. PATENT DOCUMENTS

| | | | |
|---|---|---|---|
| 1,729,723 | 10/1929 | Huntley | 123/495 |
| 1,903,481 | 4/1933 | Schweisthal | 123/509 |
| 2,411,312 | 11/1946 | Yonkers | 123/495 |
| 3,548,715 | 12/1970 | Bobst | 417/199 |
| 3,840,087 | 10/1974 | Loewis et al. | 123/495 |
| 4,411,239 | 10/1983 | Kelch | 123/516 |

*Primary Examiner*—Magdalen Y.C. Moy

*Attorney, Agent, or Firm*—Toren, McGeady and Stanger

[57] ABSTRACT

A booster pump for a secondary fuel circulation system of a diesel engine adapted to be connected with the fuel pump of the primary circulation system by removing a screw plug associated with a piston chamber of the fuel pump in order to permit the booster pump to be threadedly engaged in place thereof by means of a threaded member formed on the housing of the booster pump. A spring actuated piston of the booster pump is thus brought into active connection with a piston of the fuel pump by way of a plunger protruding from the housing of the booster pump.

1 Claim, 4 Drawing Figures

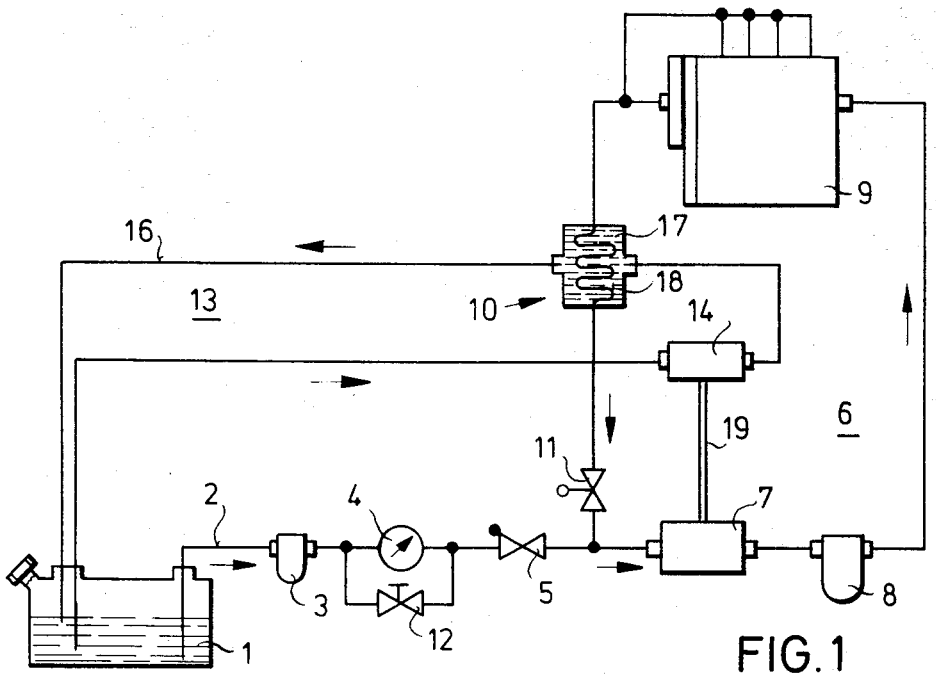
FIG. 1
FIG. 2
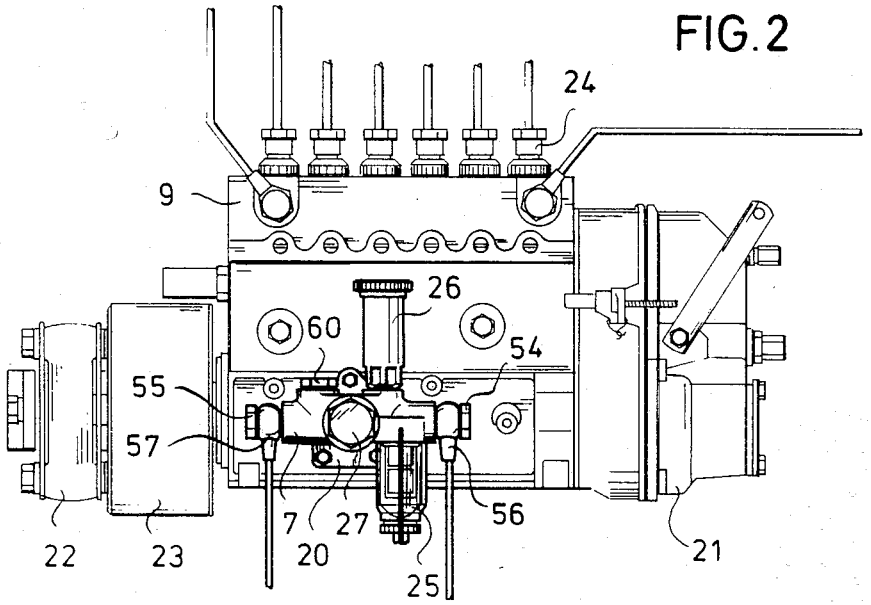

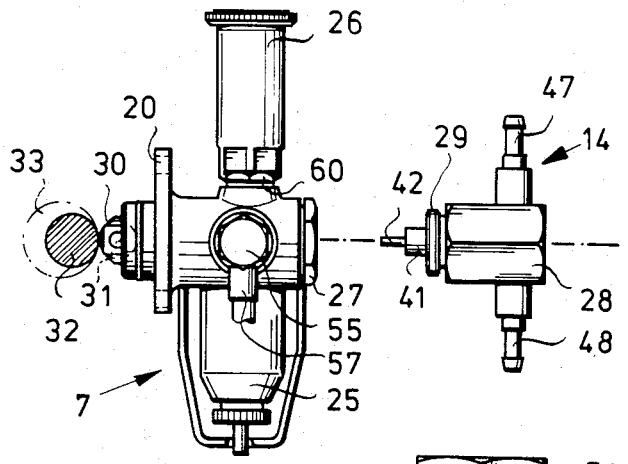
FIG. 3
FIG. 4
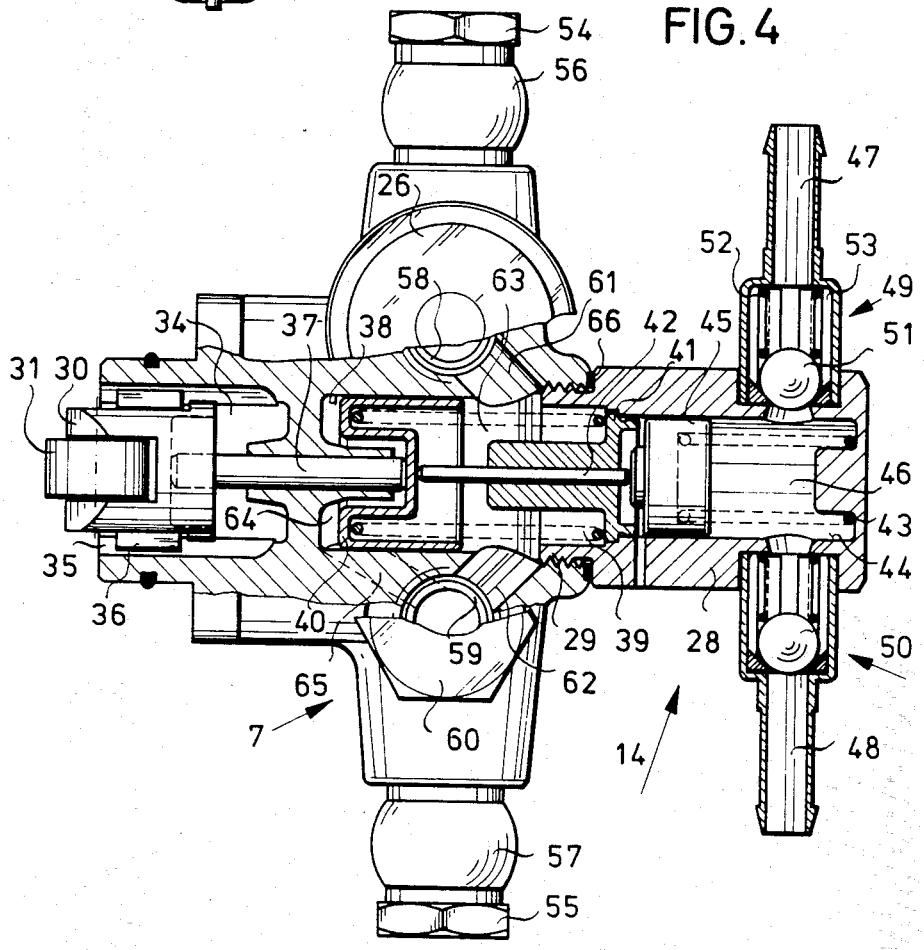

BOOSTER PUMP ARRANGEMENT FOR FEEDING A SECONDARY CIRCULATION SYSTEM IN THE OPERATIVE SYSTEM OF A DIESEL ENGINE

The present invention relates generally to fuel circulation systems for diesel engines and more particularly to the arrangement of a booster pump which feeds an additional or secondary circulation system in the operative system of the diesel engine.

In systems of the type to which the present invention relates, the primary or operative system of the diesel engine is equipped with an injection pump having a mechanical piston pump operatively associated therewith which operates as the fuel pump. This fuel pump is preferably actuated by an eccentric member disposed on the cam shaft of the injection pump and the fuel pump includes a piston chamber which is closed at one end wall away from the driving eccentric by means of a threaded plug or member. The secondary or additional circulation system fed by the booster pump may be utilized, for example, as a cooling circulation system as described in the prior art in DE-No. A 31 07 141. Such an arrangement is one wherein fuel consumption is measured simply by a quantity measuring device and wherein the operative system of the diesel engine provides for a closed fuel circulation which is hereinafter referred to as the injection or primary circulation system.

Such an injection circulation system in which, as is known in the art, more fuel is circulated for the cooling of the injection pump, among others, than is given off by the injection pump and is hence consumed, is maintained in circulation by the fuel pump which is normally comprised of a mechanical piston pump which independently of the operative system is generally flanged directly onto the injection pump or in rare cases onto the engine. In those cases in which the fuel pump is connected with the injection pump, the fuel pump is driven by an eccentric member disposed on the cam shaft of the injection pump.

The injection circulation system is connected with a fuel tank by means of an open suction line which is coupled in a suitable manner with the primary or injection circulation system within which a quantity measuring device is provided.

In a closed primary or injection circulation system, the circulating fuel heats up to a considerable degree and, as a result, the cooling function of the injection circulation system is lost. The most effective method for limiting temperature rise in the injection circulation system is considered to be assignment of a heat exchanger to the injection circulation system in which an active cooling fluid is circulated which is isolated from the injection circulation system and which is fed from the fuel tank by means of an additional pump.

Apart from operational safety, one of the most important requirements in such a system which must be fulfilled by the secondary or additional arrangement is that this arrangement should be capable of being installed independently of the type of vehicle with which it is utilized and it therefore should be suitable for retrofitting and capable of attachment with a minimum of space requirements and assembly effort.

Under such circumstances, the selection of a booster pump for such a secondary circulation system is, of course, significant in that there must be utilized a pump which is equipped with its own electric drive unit, as indicated in the prior art previously mentioned, because of the necessity for retrofitting ability and the reduction in assembly effort.

By contrast with a pump which is exclusively actuated with mechanical means, which would require considerable expense for provision of a drive connection and for arrangement of such a pump within the engine space, an electrically operated pump simply requires an electrical connection and, as compared with the mechanical piston or membrane pump, the attachment of such a pump provides significant leeway and may accordingly be connected, for example, directly with the heat exchanger for the creation of a functional assembly, as indicated in the prior art previously cited.

On the other hand, apart from cost considerations, an electrically operating booster pump involves considerable functional risks which must be accepted, particularly for intended use in the operative system of a diesel engine. Thus, for example, the life of such a pump may be limited by considerable thermal and shock loads. A further source of malfunction may be the floating of the brushes due to a relatively high viscosity diesel fuel film and premature brush burnoff resulting therefrom.

It will be thus appreciated that, with respect to utilization of such a device as a booster pump for an additional or secondary circulation system in the operative system of the diesel engine, the problems to be solved include improvement in safety of operation, preservation of retrofitting ability and capacity for reducing cost and assembly complexity to the degree possible.

The present invention is directed toward provision of an arrangement enabling such a booster pump to be utilized in a manner which generally overcomes the aforementioned difficulties.

SUMMARY OF THE INVENTION

Briefly, the present invention may be described as a fuel system for a diesel engine comprising: a primary fuel circulation system; an injection pump and a fuel pump in said primary system, said fuel pump consisting of a mechanical piston pump including a piston operatively associated with the injection pump and operating as the fuel pump for said primary system; a pump crankshaft and eccentric means in said injection pump for actuating said fuel pump; a piston chamber in said fuel pump having an end wall located away from said eccentric means; a threaded plug in said end wall closing said piston chamber; threaded means in said end wall for receiving said threaded plug in sealing engagement therein; a secondary fuel circulation system including a booster pump for feeding said secondary system; a housing of said booster pump having provided thereon a threaded member similar to said threaded plug adapted to be attached with said threaded means in said end wall for connecting said booster pump onto said fuel pump in operative association therewith; said booster pump and said threaded plug being thereby adapted to be interchangeably attached with said fuel pump; said booster pump being constructed as a mechanical piston pump including a spring actuated piston which is adapted to be placed in operative connection with said piston of said fuel pump; and a plunger provided in said booster pump protruding from said housing thereof for placing said piston of said booster pump in operative association with said piston of said fuel pump when said booster pump is connected with said fuel pump.

Thus, the present invention provides advantages over the prior art in that the booster pump may be connected directly with the fuel pump in such a way that on the housing of the booster pump there is provided a threaded member which matches the threaded plug of the fuel pump and is integrally formed on the booster pump so as to be screwed onto the fuel pump in place of the threaded plug. The booster pump is designed as a mechanical piston pump and the spring supported piston of the booster pump is brought into operative engagement with the piston of the fuel pump by way of a plunger protruding from the housing of the booster pump.

Thus, the structure of the present invention combines together in a greatly simplified design of the booster pump the advantages of high safety of operation with a minimum of assembly cost without requiring either additional fastening elements or preparatory machining for their installation. Another advantageous feature of the invention is that the selected arrangement permits simple exchange of the booster pump and retrofitting thereof without special construction or assembly procedures.

The various features of novelty which characterize the invention are pointed out with particularly in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DESCRIPTION OF THE DRAWINGS

In the drawings:

FIG. 1 is a schematic view of an injection circulation system for a diesel engine wherein the present invention may be advantageously utilized;

FIG. 2 is a side view of a banked injection pump having a fuel pump flanged thereto;

FIG. 3 is a graphic illustration showing a fuel pump and a booster pump demonstrating the manner of assembly thereof; and FIG. 4 is a sectional view showing the booster pump and the fuel pump fitted together.

DETAILED DESCRIPTION OF THE PREFERRED EMBODIMENT

Referring now to the drawings and particularly to FIG. 1, there is shown an injection circulation system for a diesel engine operative system having a quantity measuring device in the suction zone and an additional circulation system which operates to cool the injection circulation system. The injection circulation system may be referred to as the primary system and the additional or cooling circulation system as the secondary system.

In the schematic view of FIG. 1, the system is shown as including a fuel tank 1, a suction line 2 which is open on the tank side in which there are inserted a prefilter member 3, a quantity measuring device 4 and a check valve 5. The injection fuel circulation system or the primary system is identified with reference numeral 6 and is shown as a closed fuel circulation system in which there is maintained in circulation in a known manner a certain quantity of fuel. The fuel is delivered by a fuel pump 7 through a main filter 8 to an injection pump 9 and then through a heat exchanger 10 to a refeed valve 11.

A bypass 12 is associated with the quantity measuring device 4 and serves to bypass fuel around this device in cases of malfunction.

Another or secondary fuel circulation system 13 is provided to operate as a cooling circulation system. The secondary system 13 is fed by an additional or secondary pump which consists of a booster pump 14.

The secondary cooling circulation system 13 is arranged in thermal contact in the heat exchanger 10, on the one hand, with the primary injection circulation system 6 and, on the other hand, by means of a suction line 15 and a return line 16 is in connection with the fuel tank 1 so that the heat exchanger 10, which, in the embodiment shown in FIG. 1, is designed as a tank 17 assigned to the secondary cooling circulation system 13 with a cooling body 18 associated with the circulation system 6, is always traversed by cool fuel from the fuel tank 1 and thus heat removal, i.e., effective cooling, is ensured. A mechanical coupling 19 which is schematically shown in FIG. 1 is provided between the fuel pump 7 and the booster pump 17 and this mechanical coupling while shown schematically in FIG. 1 will be described in greater structural detail hereinafter.

In FIG. 2, there is shown a usual arrangement of the fuel pump 7 at the injection pump 9 wherein the fuel pump 7 is directly attached to the injection pump 9 by means of a flange 20 thereon. For the sake of completeness, the remaining units which are associated with the injection pump 9 are shown and they include a speed governor 21, a clutch 22 provided between the motor crankshaft (not shown) and the cam shaft of the injection pump 9 and an injection timing device 23. The injection pump 9 also contains pressure valves 24 and the fuel pump 7 has assigned thereto on the suction side a filter 25 and a hand pump 26 with the piston chamber of the fuel pump 7 being closed by a threaded plug 27.

FIG. 3 shows the fuel pump 7 and the booster pump 14 arranged relative to each other in order to indicate the manner in which these units may be assembled together. In the representation of FIG. 3, it will be evident that the booster pump 14 may be installed onto the fuel pump 7 in a very simple manner so as to enable operative engagement of the parts. The booster pump 14 is provided with a housing 28 having a threaded projection 29 which matches the thread of the screw plug 17. The fuel pump 7 is provided with a roller 31 protruding therefrom and mounted in a support 30. In its operative condition, the fuel pump 7 is coupled with an eccentric 33 disposed on the injection pump crankshaft 32.

Thus, it will be apparent that by removing the screw plug 27 from the housing of the fuel pump 7 and by inserting in its place the threaded projection 29, the booster pump 14 may be readily attached with the fuel pump 7 and maintained connected in operative engagement therewith.

The fuel pump 7 and the booster pump 14 are shown in greater detail in connected engagement in FIG. 4. As shown in FIG. 4, the roller support 30 is guided in a bore 34 and is secured against rotation by means of a dual groove-and-tongue connection 35–36. As will also be seen from FIG. 4, the roller support 30 acts upon a set bolt 37 which is displaceable in the housing 28 of the fuel pump 7 and upon which there is supported a piston 40 of the fuel pump 7 which is guided in a piston bore 38 and urged by a piston spring 39.

The fuel pump 7 is equipped in the usual manner with the screw plug 27 of the piston spring 39 serving as an abutment. In the design, according to the invention, the piston spring 39 serves as an abutment and the piston spring 39 also is supported on the housing 28 of the booster pump 14 or, respectively, on a bearing part 41 pressed into the housing 28. Guided in the bearing part 41 is a ram or plunger 42 which, when the booster pump 14 is in threaded engagement with the fuel pump 7, is in operative connection under the action of a spring 43, on the one hand, with piston 40 and, on the other hand, with a piston 45 mounted in a bore 44 formed in the housing 28 of the booster pump 14. The plunger 42 and the spring 43 thus constitute the coupling 19 shown schematically in FIG. 1 and thus it will be seen that the plunger 42 and the spring 43 represent in mechanical or structural form the schematic coupling 19.

The booster pump 14 is formed with a suction and compression chamber 46 which has associated therewith hose connections 47 and 48 within which there are provided integrated ball valves 49 and 50 which act as check valves, each consisting of a ball 51, a spring 52 and a ball cage 53.

For the sake of completeness, it should be mentioned further that the fuel pump 7 may be included both on the suction side and on the compression side in the respective fuel circulation system through an annular pipe connection 56, 57 which is fastened by means of a female thread 54, 55 and also that on the suction side and compression side, respectively, a check valve is provided. In FIG. 4, there are shown only the respective valve seats 58 and 59 of these check valves and the parts supporting the check valve springs, i.e., on the one hand, the hand pump 26 or its housing which is to be in threaded engagement into the valve space and, on the other, a screw plug 60 which opens and closes respective passages 61, 62 to a suction chamber 63.

Additionally, the fuel pump 7 is provided with a compression chamber 64 which communicates with a pressure side drain through a suitable passage 65. A seal 66, which is preferably a soft metal seal, is provided between the fuel pump 7 and the booster pump 14.

Thus, it will be seen that in accordance with the present invention, the fuel circulation system of a diesel engine may be provided with a booster pump 14 for a secondary circulation system which is adapted to retrofitting with high safety of operation and without any special assembling effort. The booster pump 14 is a mechanical piston pump which is readily connected with the fuel pump 7 merely by removal of the screw plug 27 associated with the piston chamber 38 of the fuel pump 7 and with subsequent threading on in its place of the booster pump 14 by means of threaded engagement of the threaded member 29 formed on the housing 28 of the booster pump 14. Thus, the spring supported piston 45 of the booster pump 14 will be brought into active connection with the piston 40 of the fuel pump 7 by way of the plunger 42 which protrudes from the housing 28 of the booster pump 14 and which extends into the fuel pump 7 in active operative engagement therein.

While a specific embodiment of the invention has been shown and described in detail to illustrate the application of the inventive principles, it will be understood that the invention may be embodied otherwise without departing from such principles.

What is claimed is:

1. A fuel system for a diesel engine comprising:

a primary fuel circulation system;

an injection pump and a fuel pump for said primary fuel circulation system, said fuel pump consisting of a mechanical piston pump operatively associated with said injection pump and operating to pump fuel for said primary circulation system;

a pump crankshaft and eccentric means in said injection pump for actuating said fuel pump;

a piston chamber in said fuel pump having an end wall located away from said eccentric means;

threaded means in said end wall adapted to receive therein a threaded plug in sealing engagement therewith;

a secondary fuel circulation system including a booster pump for feeding said secondary system;

a housing of said booster pump having provided thereon a threaded member adapted to be threadedly engaged with said threaded means in said end wall of said fuel pump for connecting said booster pump onto said fuel pump in operative association therewith;

said booster pump being thereby adapted to be interchangeably attached with a threaded plug adapted to engage said threaded means in sealing engagement;

said booster pump being constructed as a mechanical piston pump including a spring actuated piston which is adapted to be placed in operative connection with said piston of said fuel pump; and a plunger provided in said booster pump protruding from said housing thereof for placing said piston of said booster pump in operative association with said piston of said fuel pump when said booster pump is connected with said fuel pump.

* * * * *